US009560464B2

(12) United States Patent
Choueiri

(10) Patent No.: US 9,560,464 B2
(45) Date of Patent: Jan. 31, 2017

(54) SYSTEM AND METHOD FOR PRODUCING HEAD-EXTERNALIZED 3D AUDIO THROUGH HEADPHONES

(71) Applicant: The Trustees of Princeton University, Princeton, NJ (US)

(72) Inventor: Edgar Y. Choueiri, Princeton, NJ (US)

(73) Assignee: The Trustees of Princeton University, Princeton, NJ (US)

( * ) Notice: Subject to any disclaimer, the term of this patent is extended or adjusted under 35 U.S.C. 154(b) by 0 days.

(21) Appl. No.: 14/553,605

(22) Filed: Nov. 25, 2014

(65) Prior Publication Data

US 2016/0150339 A1 May 26, 2016

(51) Int. Cl.

| | |
|---|---|
| ***H04R 5/00*** | (2006.01) |
| ***H04S 1/00*** | (2006.01) |
| ***H04R 5/033*** | (2006.01) |

(52) U.S. Cl.

CPC ..... *H04S 1/005* (2013.01); *H04R 5/033* (2013.01); *H04S 2420/01* (2013.01)

(58) Field of Classification Search

CPC ..... H04S 7/302
USPC ..... 381/309, 301, 302, 303, 17, 26
See application file for complete search history.

(56) References Cited

U.S. PATENT DOCUMENTS

| | | | | |
|---|---|---|---|---|
| 6,449,368 | B1 | 9/2002 | Davis et al. | |
| 6,668,061 | B1 | 12/2003 | Abel | |
| 6,707,918 | B1 | 3/2004 | McGrath et al. | |
| 6,738,479 | B1 * | 5/2004 | Sibbald et al. | 381/17 |
| 6,950,524 | B2 | 9/2005 | Nelson et al. | |
| 8,160,258 | B2 * | 4/2012 | Jung et al. | 381/2 |
| 8,483,413 | B2 * | 7/2013 | Hartung et al. | 381/302 |
| 8,559,646 | B2 * | 10/2013 | Gardner | 381/63 |
| 9,066,191 | B2 * | 6/2015 | Strauss et al. | |

(Continued)

FOREIGN PATENT DOCUMENTS

JP 2004-511118 A 4/2004

OTHER PUBLICATIONS

International Search Report and Written Opinion issued by the U.S. Patent and Trademark Office as International Searching Authority for Application No. PCT/US2011/50181 mailed Dec. 23, 2011 (7 pgs.).

(Continued)

*Primary Examiner* — William Deane, Jr.
(74) *Attorney, Agent, or Firm* — Wilmer Cutler Pickering Hale and Dorr LLP

(57) ABSTRACT

The system and method of the present invention rely on combining the Speakers+Room binaural Impulse Response (s) (SRbIR) with a special kind of crosstalk cancellation (XTC) filter—one that does not degrade or significantly alter the SRbIR's spectral and temporal characteristics that are required for effective head externalization. This unique combination leads to a 3D audio filter for headphones that allows the emulation of the sound of crosstalk-cancelled speakers through headphones, and allows for fixing the perceived soundstage in space using head tracking and thus solves the major problems for externalized and robust 3D audio rendering through headphones. Furthermore, by taking advantage of a well-documented psychoacoustic fact, this system and method can produce universal 3D audio filters that work for all listeners i.e. independent of the listener's head related transfer function (HRTF).

20 Claims, 9 Drawing Sheets

(56) References Cited

U.S. PATENT DOCUMENTS

| | | | | |
|---|---|---|---|---|
| 9,107,021 | B2 * | 8/2015 | Florencio et al. | |
| 2004/0170281 | A1 | 9/2004 | Nelson et al. | |
| 2004/0179693 | A1 * | 9/2004 | Abel | 381/1 |
| 2005/0135643 | A1 | 6/2005 | Lee et al. | |
| 2005/0254660 | A1 | 11/2005 | Sakurai et al. | |
| 2007/0274527 | A1 * | 11/2007 | Abel | 381/1 |
| 2009/0086982 | A1 | 4/2009 | Kulkarni et al. | |
| 2009/0238370 | A1 * | 9/2009 | Rumsey et al. | 381/58 |
| 2009/0262947 | A1 | 10/2009 | Karlsson et al. | |
| 2010/0202629 | A1 | 8/2010 | Takeuchi et al. | |
| 2011/0103620 | A1 * | 5/2011 | Strauss et al. | 381/150 |
| 2011/0170721 | A1 | 7/2011 | Dickins et al. | |
| 2011/0268281 | A1 * | 11/2011 | Florencio et al. | 381/26 |
| 2011/0286614 | A1 * | 11/2011 | Hess | 381/302 |
| 2014/0355794 | A1 * | 12/2014 | Morrell et al. | 381/303 |

OTHER PUBLICATIONS

International Search Report and Written Opinion issued by the U.S. Patent and Trademark Office as International Searching Authority for International Application No. PCT/US2015/062661 mailed Jan. 22, 2016 (11 pgs.).

* cited by examiner

SYSTEM AND METHOD FOR PRODUCING HEAD-EXTERNALIZED 3D AUDIO THROUGH HEADPHONES

BACKGROUND

This invention relates to a system and method of creating 3D audio filters for head-externalized 3D audio through headphones (which for purposes of this application shall be deemed to include headphones, earphones, ear speakers or any transducers in close proximity to a listener's ears), and more particularly to filter designs for providing high quality 3D head-externalized 3D audio through headphones.

The invention has wide utility in virtually all applications where audio is delivered to a listener through headphones, including music listening, entertainment systems, pro audio, movies, communications, teleconferencing, gaming, virtual reality systems, computer audio, military and medical audio applications.

Prior art systems and processes used for the head-externalization of audio through headphones rely on one, or a combination, of the following two methods. The first of these prior art methods (PA Method 1) uses binaural audio, i.e. audio that is acoustically recorded with dummy head microphones, or audio that is mixed binaurally on a computer using the numerical HRIR (head-related impulse response) of a dummy head or a human head. The problem with this method is that it can lead to good head externalization of sound for only a small percentage of listeners. This well documented failure to head externalized binaural sound through regular headphones for virtually any listener is due to many factors (see, for instance, Rozenn Nicol, Binaural Technology, AES Monographs series, Audio Engineering Society, April 2010), One such factor is the mismatch between the HRIR of the head used to record the sound and the HRIR of the actual listener. Another important factor is the lack of robustness to head movements: the perceived audio image moves with the head as the listener rotates his head, and this artifice degrades the realism of the perception. With PA Method 1 it is impossible to use existing head tracking techniques to fix the perceived audio image because the locations of sound sources is generally unknown in an already recorded sound field.

The second prior art method (PA Method 2) filters the audio through digital (or analog) filters that represent or emulate the binaural impulse response of loudspeakers in a listening room. (such filters are referred to as SRbIR filters, where "SRbIR" stands for "Speakers+Room binaural Impulse Response"). An advantage of this method over PA Method 1 is that existing head tracking techniques can readily be used to fix the perceived audio image in space (thereby greatly increasing the robustness to head movements and therefore enhancing the realism of the perceived sound field) as the location of the speakers is effectively known since convolution of the input audio with the SRbIR measured or calculated at various head positions (three positions covering the range of expected head rotation are usually sufficient to extrapolate the SRbIR at other head rotation angles) could be changed as a function of the head location using head tracking so that the listener perceives the sound coming from loudspeakers that are fixed in space. However, while PA Method 2 can lead to good head externalization of sound, it emulates the sound of regular loudspeakers whereby the sound is not truly three-dimensional (i.e. does not extend significantly in 3D space beyond the region where the loudspeakers are perceived to be located.)

Combining these two prior art methods can lead to good head externalization of sound and the ability to use head tracking but the benefits of the binaural audio are largely lost as the sound of binaural audio through regular loudspeakers is not truly 3D since the transmission of the inter-aural time difference (ITD), inter-aural level difference (ILD) and spectral cues in the binaural recording through loudspeakers is severely degraded by the crosstalk (the sound from each loudspeaker reaching the unintended ear).

Although not reported in the literature or in any known prior art, it would seem possible to make the second process described above yield high quality 3D sound (while still head externalizing the sound) by using, in addition to the SRbIR filter, a crosstalk cancellation (XTC) filter with the goal of emulating the sound of crosstalk-cancelled loudspeakers playback. Such a process, however, does not yield the desired quality sound because a regular XTC filter will remove or significantly degrade the crosstalk that is inherently represented in the SRbIR filter and which is critical for head externalization of sound through headphones.

It is therefore a principal object of the present invention to provide and system and process for providing more effective head-externalization of 3D audio through headphones.

SUMMARY

The system and method of the present invention bypass the shortcomings of the prior art systems and methods described above by solving the problem of head-externalization of audio through headphones for virtually any listener, and create a truly 3D audio soundstage, even from non-binaural recordings. In addition, with binaural recordings the system and process of the present invention enable virtually all listeners to hear an accurate 3D representation of the binaurally recorded sound field.

The system and method of the present invention rely on combining the Speakers+Room binaural Impulse Response (s) (SRbIR) with a special kind of crosstalk cancellation (XTC) filter—one that does not degrade or significantly alter the SRbIR's spectral and temporal characteristics that are required for effective head externalization. This unique combination allows the emulation of crosstalk-cancelled speakers and thus solves all three major problems for externalized and robust 3D audio rendering through headphones. Specifically, this combination:

1) externalizes sound effectively for virtually any listener, i.e. any listener with no differential hearing loss, (which PA Method 1 cannot do), thanks to the spectrally and temporally intact SRbIR;

2) allows the use of existing head tracking techniques to fix the perceived audio image in space (which PA Method 1 cannot do); and 3) produces a 3D audio image (as opposed to the audio image produced by non-crosstalk cancelled speakers) by delivering a much less limited range of the ITD and ILD cues (and spectral cues, in case of binaural recordings) that are required for the perception of a 3D image (which PA Method 2 cannot do).

The practical application, universality and success of the method is further assured by its reduction of the problem of reproducing the location of (often) multiple sound sources in the recording, whose locations are generally unknown, to simply emulating the sound of crosstalk cancelled speakers whose position is fixed in space in the front part of azimuthal plane, which allows taking advantage of the well-documented psychoacoustic fact that localization of sound sources in the front part of the azimuthal plane is largely insensitive to differences between individual head related transfer functions (HRTF).

Taking advantage of this last fact allows the system and method of the present invention to produce non-individualized (i.e. universal) filters that effectively externalize 3D sound from headphones for all listeners. It is an important experimentally-verified feature of the present invention that these non-individualized filters are practically as effective as individualized ones.

DETAILED DESCRIPTION

Figure 1:
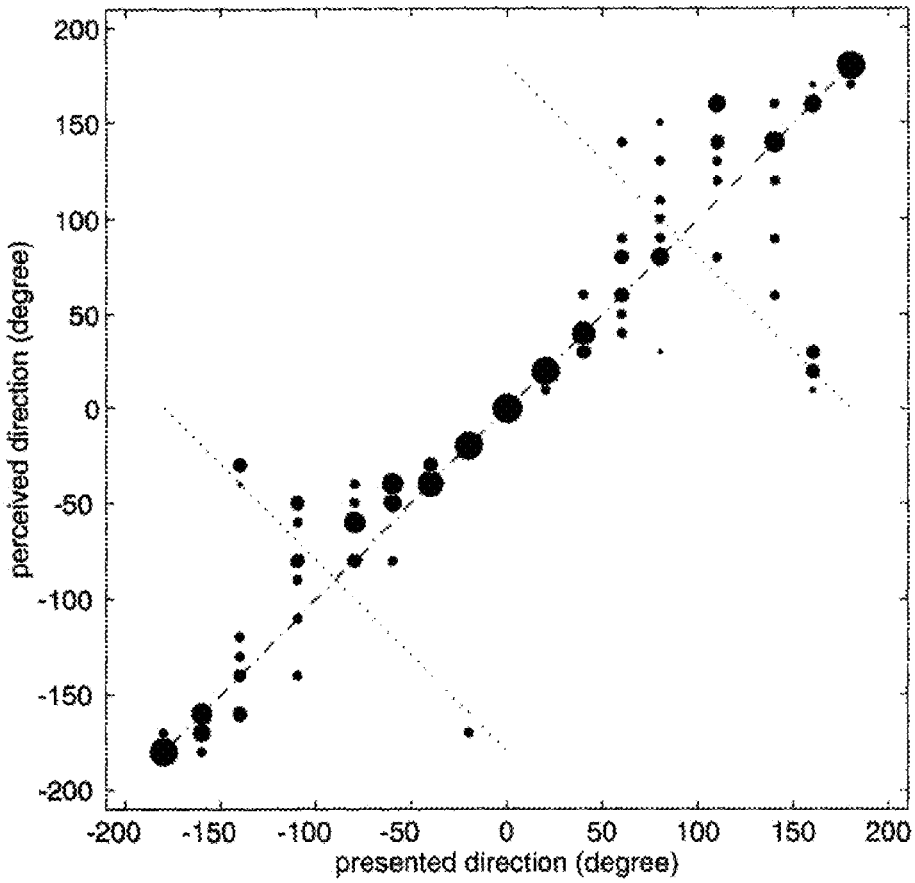
FIG. 1 is a plot showing the subjective testing results of listeners who were asked to locate a sound projected through a virtual acoustic imaging system (using the listener's HRTF) to a location in the azimuthal plane

The first key to the present invention is the use of a special kind of XTC filter that, when combined with an SRbIR filter, does not interfere with, or audibly decrease, the head-externalization ability of the SRbIR filter, (i.e. does not alter its spectral characteristics). This special kind of XTC filter is one that is designed to utilize a frequency dependent regularization parameter (FDRP) that is used to invert the analytically derived or experimentally measured system transfer matrix for the XTC filter. The FDRP that is calculated results in a flat amplitude vs flat frequency response at the loudspeaker (as opposed to at the ears of the listeners). Such a filter is described in PCT Application No. PCT/US2011/50181 entitled "Spectrally uncolored optimal crosstalk cancellation for audio through loudspeakers", the teachings of which are incorporated herein by reference. This special kind of XTC filter will be referred to herein as a spectrally uncolored crosstalk cancellation filter, or SU-XTC filter (also often referred to commercially by "BACCH filter", where BACCH is a registered trademark of The Trustees of Princeton University.)

The particular property of the SU-XTC filter that makes its combination with an SRbIR filter lead to very effective head-externalized 3D audio through headphones is its flat frequency response (amplitude spectrum), which is the foremost characteristic of the SU-XTC filter. This flat frequency response (or lack of spectral coloration) allows the frequency response (amplitude spectrum) of the SRbIR filter to be largely unaffected by the combination of the two filters. Any other type of XTC filter, which by definition is an XTC filter with a frequency response that significantly departs from a flat response, would lead to a tonal distortion of the SRbIR filter when the two filters are combined, thereby compromising the spectral cues, encoded in the SRbIR, that are necessary for head externalization of sound through headphones. XTC filters with an essentially flat frequency response can be used in the present invention. A filter having an "essentially flat frequency response" would be a filter which does not cause an audible change to the tonal content of an audio signal that is filtered by it. For example, a filter whose frequency response is free over the audio range from any wideband (1 octave or more) departures of 1 dB or more from completely flat response and/or any narrowband (less than 1 octave) departures of 2 dB or more from completely flat response, can be considered audibly flat.

Another requirement of the XTC filter (which is met by the SU-XTC filter) for the system and method of the present invention is that this filter be anechoic, that is either designed from measurements done in an anechoic chamber, or more practically obtained by simply time-windowing the initial IRs to exclude all but the direct sound (typically using a time window of about 3 ms) as explained further below.

Including much more than the anechoic part of the IR in designing the XTC filter of the present invention would lead to a degradation of the sound externalization capability of the final headphones filter. This is easily explained by the fact that the SRbIR emulates the crosstalk of speakers listening, while a non-anechoic XTC filter would act, upon combination with the former, to cancel this same crosstalk (through, at least partly, the XTC's filter frequency response and mostly its extended non-anechoic time response) therefore leading to the naturally crosstalk-cancelled sound of regular headphones listening (which inherently suffers from head internalization).

In essence, the 3D sound filter of the present invention (which will be referred to herein as a "SU-XTC-HP filter" (where HP stands for "headphones processing" or "headphones processor" is a proper combination (as prescribed by the invented method whose steps are described below) of a SU-XTC filter and an SRbIR filter, which (when combined with appropriate head tracking) allows an excellent and robust emulation of crosstalk-cancelled speakers playback through headphones. The listener would hear a soundstage that is essentially the same as that he or she would hear by listening to a pair of loudspeakers through a flat frequency response crosstalk cancellation filter (the SU-XTC filter), with no tonal coloration (distortion). Since listening to loudspeakers with a SU-XTC filter leads to a 3D sound image, the resulting headphones image through the SU-XTC-HP filter is essentially the same 3D sound image.

Figure 2:
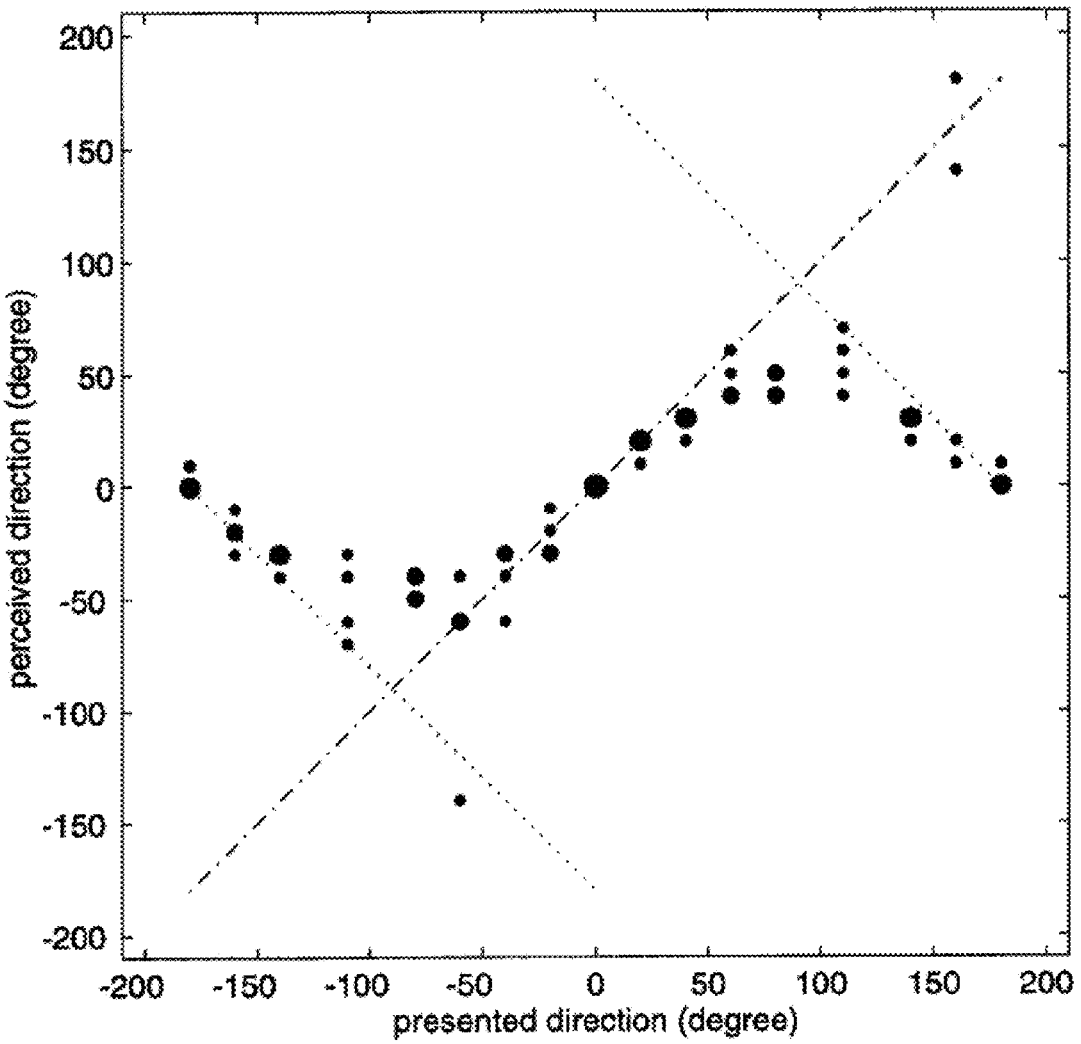
FIG. 2 is a plot of the subjective test results using a dummy HRTF instead of individual HRTFs used in FIG. 1.

The practical application, universality and success of the method of the present invention are further assured by its reduction of the problem of reproducing the location of (often) multiple sound sources in the recording, whose locations are generally unknown, to simply emulating the sound of XTC-ed speakers whose position is fixed in space in the front part of the azimuthal plane (typically within +/−45 degree azimuthal span from the listener's position), which allows taking advantage of the well-documented psychoacoustic fact that localization of sound sources in the front part azimuthal plane (within an azimuthal span angle of +/−45 degrees) is largely insensitive to differences between individual head related transfer functions (HRTF). This fact is clearly illustrated in FIGS. 1 and 2, (taken from T. Takeuchi et al. "Influence of Individual HRTF on the performance of virtual acoustic Imaging Systems" Audio Engineering Society Convention 104, May 1998.) In FIG. 1 the subjective testing results involving a large number of listeners are shown graphically. The listeners were asked to locate a sound projected through a virtual acoustic imaging system to a location in the azimuthal plane having an angular coordinate represented by the x-axis of the plot. The y-axis denotes the perceived azimuthal location, and the size of each dot is proportional to the number of people who perceived the sound at that location. In FIG. 1 the sound virtualization was made using the measured individual HRTF for each listener and as expected the data largely follows a straight line (y=x) indicating good localization. FIG. 2 shows the results of a similar set of experiments but using, instead of the individual HRTFs, a single HRTF of a dummy head (the KEMAR dummy). It is clear from FIG. 2 that while at high azimuthal angles the errors in sound localization become severe, for front azimuthal angles (+/−45 degrees) sound localization is good even though they are listening to a sound filtered by a generic dummy HRTF.

This felicitous psychoacoustic fact, aside from underlying the universality of the SU-XTC-HP filter for various listeners, has the useful practical implication that the SRbIR filter can be constructed from a measurement made with a single dummy head, or calculated/simulated using a dummy (or a single individual) HRTF, since the loudspeakers (or virtual speakers) used for measuring (or calculating) the SRbIR can be arbitrarily positioned in the front part of the azimuthal plane (within an azmiuthal span angle of +/−45 degrees), as long as the SU-XTC filter is designed (or calculated) for that same geometry.

This ability of the SU-XTC-HP filter to very robustly and effectively externalize binaural audio in 3D through headphones far better than could be done previously with headphones, means that the percentage of people who could effectively externalize binaural audio in full 3D through headphones has risen from a few percent (those very few listeners whose HRIR is close to that of the head used to make the binaural recording) to virtually 100% (practically any listener without severe or differential hearing loss). That is one of the main advantages of the SU-XTC-HP filter with respect to regular binaural audio playback through speakers (PA Method 1). This is in addition to the ability of the SU-XTC-HP filter to externalize regular stereo (i.e. non-binaural) recordings through headphones resulting in a perceived 3D image that is essentially the same as that can be obtained from SU-XTC-filtered loudspeakers playback.

It is important to state that the usefulness of the system and method of the present invention is further assured by the fact that SU-XTC-HP filter does not audibly impart to the perceived sound the reverb characteristics of the room represented by the windowed SRbIR filter, unless if the input audio to be processed by the SU-XTC-HP filter was recorded anechoically (i.e. contains no reverb). This is because the perceived reverb tail of the processed input audio, will be x dB louder than that of reverb tail of the SRbIR, where x is the difference between the amplitude of the SRbIR's peak and the average amplitude of its reverb tail, and thus the recorded reverb will, in practice, always dominate since in x is above 20 dB, or can easily be made to be that much or higher by design.

Figure 3:
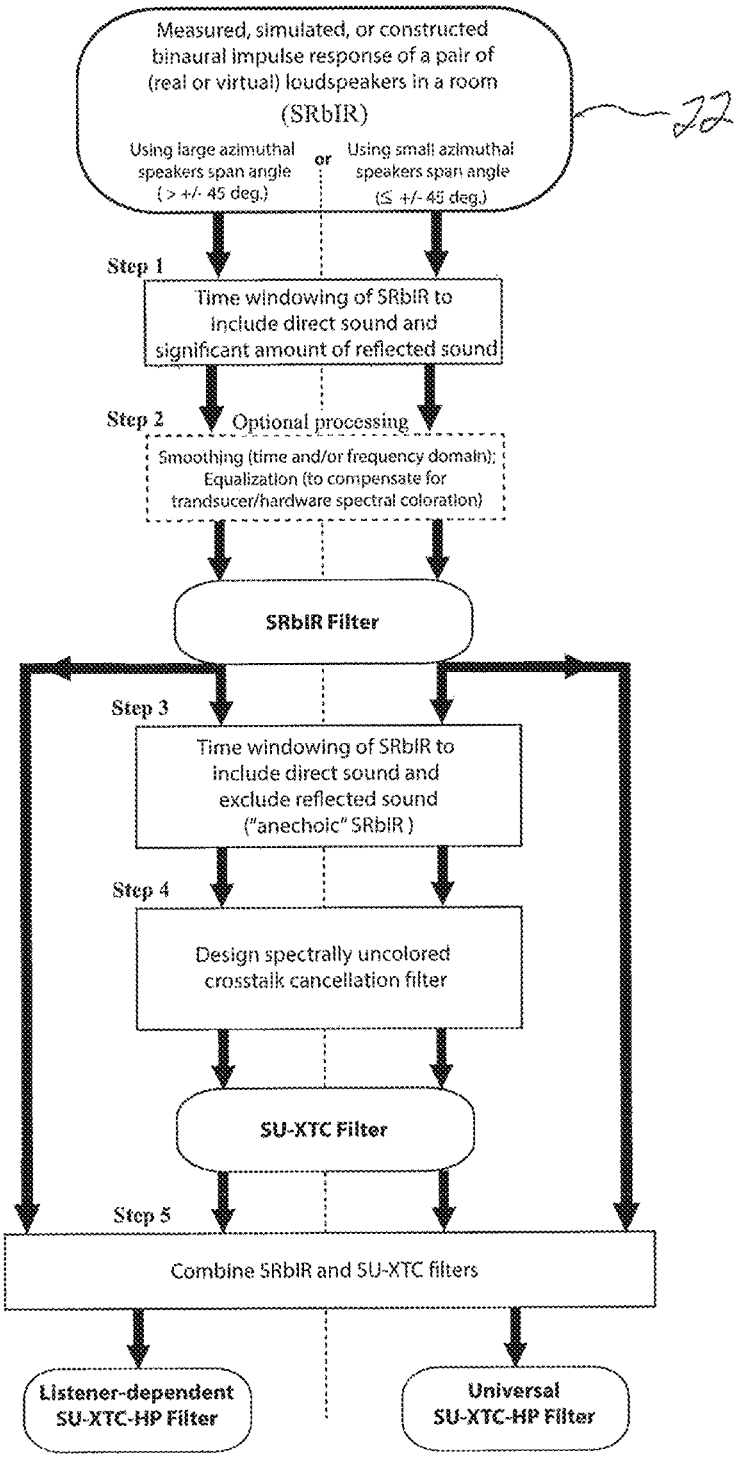
FIG. 3 is a flow chart of the process of the present invention for producing audio filters for processing audio signals to produce a head-externalized 3D audio image.

The new process to create the SU-XTC-HP filter comprises the following five main steps:

Step 1: Referring to FIG. 3, the measured (with in-ear binaural microphones worn by the intended listener or a dummy head) or simulated binaural impulse response of a pair of loudspeakers is windowed with a sufficiently long time window to include the direct sound and enough room reflections to simulate loudspeakers in a real room (typically a 150 ms or longer window is needed). The windowed binaural impulse response, even with no further processing, can serve as the sought SRbIR filter, which, if convolved through a 2×2 (true stereo) convolution with any stereo input signal then fed to headphones, would give a listener the perception of audio coming from the loudspeakers. However, as discussed in connection with Step 2 below, this windowed binaural IR of the speakers is often further processed to optimize it for use as the SRbIR filter in the system and method of the present invention. Thanks to the psychoacoustic fact described above, the system and method of the present invention, when the azimuthal span of the (actual or virtual) loudspeakers is made to be small (typically within +/−45 degree azimuthal span from the listener's position), will yield an SU-XTC-HP filter whose perceptual performance is inherently insensitive to the individual's HRTF and therefore, in such a case, it is not necessary to carry out this measurement with the intended listener. Instead, and often more practically, a dummy head can be used for that measurement, or equivalently the SRbIR can be constructed numerically using the generic HRTF of a dummy or a single individual who may well be different than the intended listener. This is illustrated by the dichotomy in the input 22 of the method shown in FIG. 3, where SRbIRs obtained with large speakers span angles would, at the end of the process, lead to listener-dependent SU-XTC-HP filters that should be used by the listener whose HRTF was used to design the SRbIR filter, while those obtained with small speakers span angles lead to listener-independent (i.e. universal) SU-XTC-HP filters that can be used by any listener.

This SRbIR filter can also, in principle, be constructed by convolving (i.e. applying, through digital means, the standard mathematical operation of convolution, in either the time or frequency domain, commonly used to apply digital filters to signals) a generic (non-individualized) impulse response (either measured with a single omni-directional microphone or constructed through a computer simulation) (e.g. simulating a point source with reflections from nearby surfaces) of a single speaker in a room, with the measured (or constructed) HRIR of a human listener or dummy head. This (relatively more demanding) process for constructing the SRbIR offers the advantage of the ability to change, a postiriori, the sound of the speakers and room emulated by the SU-XTC-HP filter.

Figure 4:
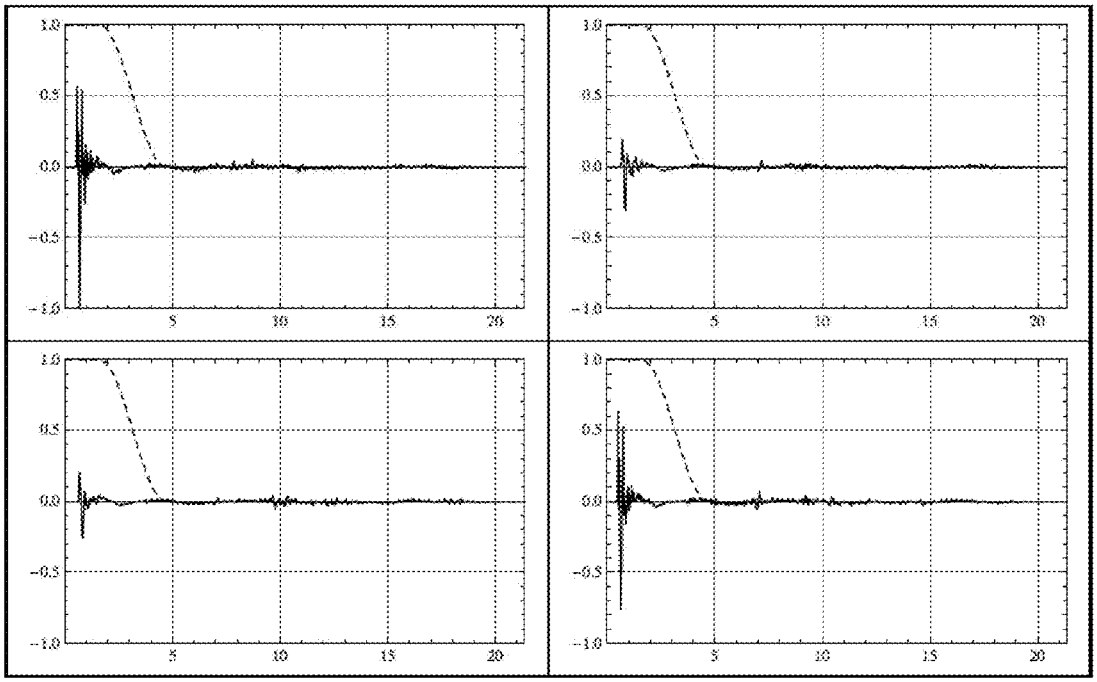
FIG. 4 are plots of the measured four impulse responses of a typical SRbIR.

It should be obvious that the SRbIR filter in fact consists of 4 actual IRs (each representing the IR of the sound from one of the two speakers measured in one of the two ears). The 4 IR of a typical SRbIR are shown in FIG. 4. The IRs are shown in 4 panels: top left: left ear/left speaker; bottom left: left ear/right speaker; top right: right ear/left speaker; and bottom right: right ear/right speaker). For the sake of clarity, only the first 20 ms of the IRs are shown in this figure but the actual windowed IRs used extend much longer (typically 150 ms or more to include enough room reflections as described above). (The dashed curves in these plots represent the time window used for designing the SU-XTC as described below in connection with Step 3.

Figure 5:
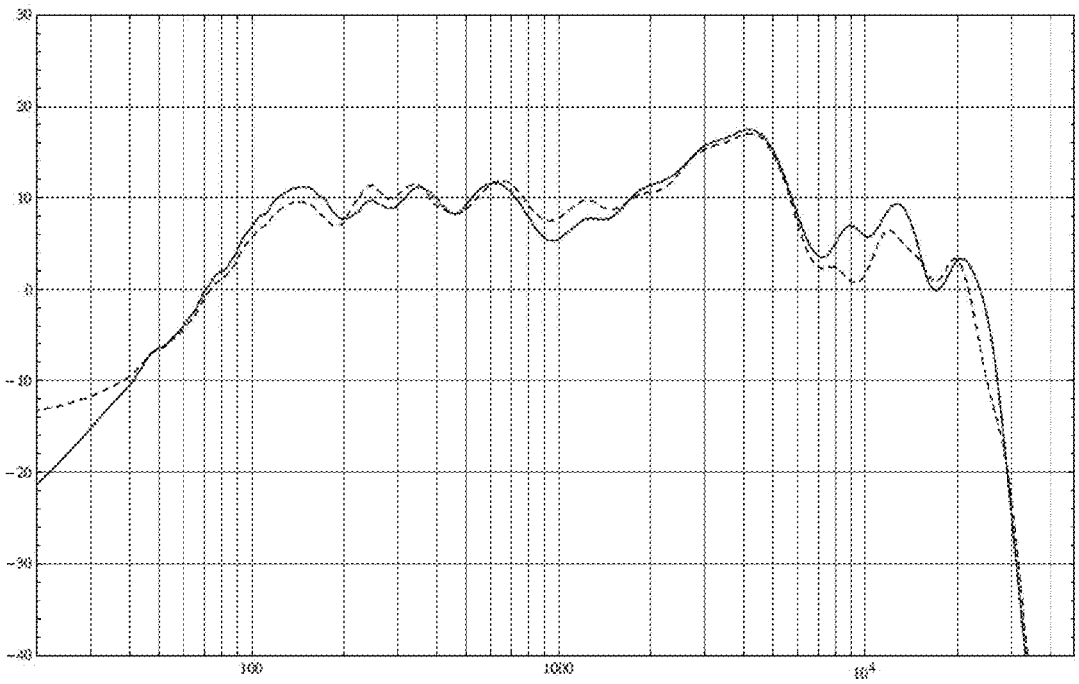
FIG. 5 is a plot of the frequency response for two impulse responses of the SRbIR shown in FIG. 4.

For reference, the frequency response (for two IRs) of this SRbIR is shown in FIG. 5 (solid curve: Left ear/left speaker;

dashed curve: right ear/right speaker). (Like all spectral plots in the other Figures, the x-axis is frequency in Hz and the y-axis is amplitude in dB.)

Step 2: The SRbIR can then optionally be processed (but this processing can be skipped for reasons explained in the next paragraph) to optimize its head-externalization capability and, if needed, reduce the storage and CPU requirements of the final filter. Such processing may include smoothing (in the time or frequency domains) and equalization using standard techniques for inverse filtering that would remove (or compensate for) the spectral coloration of the in-ear microphones used in Step 1 and that of the intended headphones. Such an equalization filter can be designed by measuring the impulse response of the headphones in each ear while the listener is wearing both the in-ear microphones and the intended headphones, and using it to produce an equalization filter through any inverse IR filter design technique In certain embodiments the step of processing the SRbIR to optimize the head-externalization capability may be skipped if the in-ear microphones have a flat frequency response (or are equalized to have one) and the intended headphones are of the "open" type (like the Sennheiser HD series, or electrostatic and magnetic planar type headphones). Open headphones (i.e. whose enclosures are largely transparent to sound) have relatively low impedance between the transducers and the entrance to the ear canals, which allows skipping the equalization step without incurring a significant penalty in degrading the effectiveness of the final SU-XTC-HP filter.

Step 3: Before designing the required SU-XTC filter, the 4 IRs in the SRbIR measured (or constructed) in Step 1 are windowed using a time window that keeps the direct sound (typically up to the 2-3 ms that represent the temporal extent of the speaker's main time response) and excluding all reflected sound (all sound after that window) to remove all, or most, of the reflected sound from each of the four IRs in the SRbIRs so that the SU-XTC is designed with what is essentially the anechoic (i.e. direct sound) part of the SRbIR. An example of such a time window is shown as the dashed curves in Figure.

Step 4: The design of the required SU-XTC filter proceeds as described in PCT Patent Application No. PCT/US2011/50181, entitled "Spectrally uncolored optimal crosstalk cancellation for audio through loudspeakers", using for input the windowed SRbIR obtained in Step 3.

Figure 6:
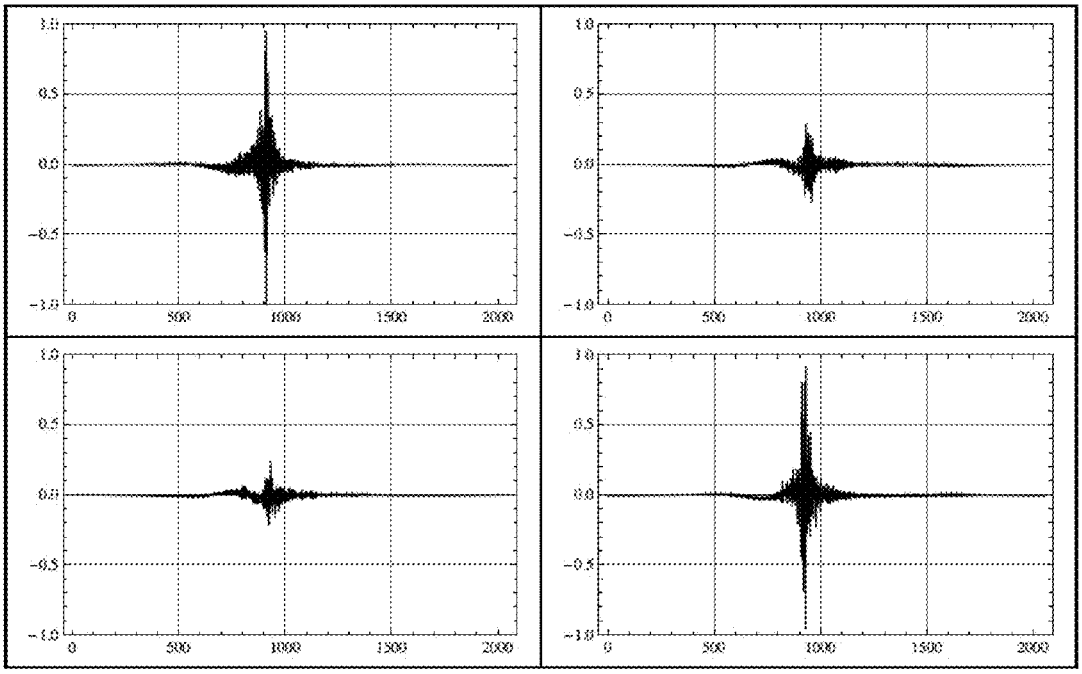
FIG. 6 is a plot of four impulse responses of the four impulse responses constituting the spectrally uncolored crosstalk cancellation (SU-XTC) filter derived from the measurements shown in FIG. 4.
Figure 7:
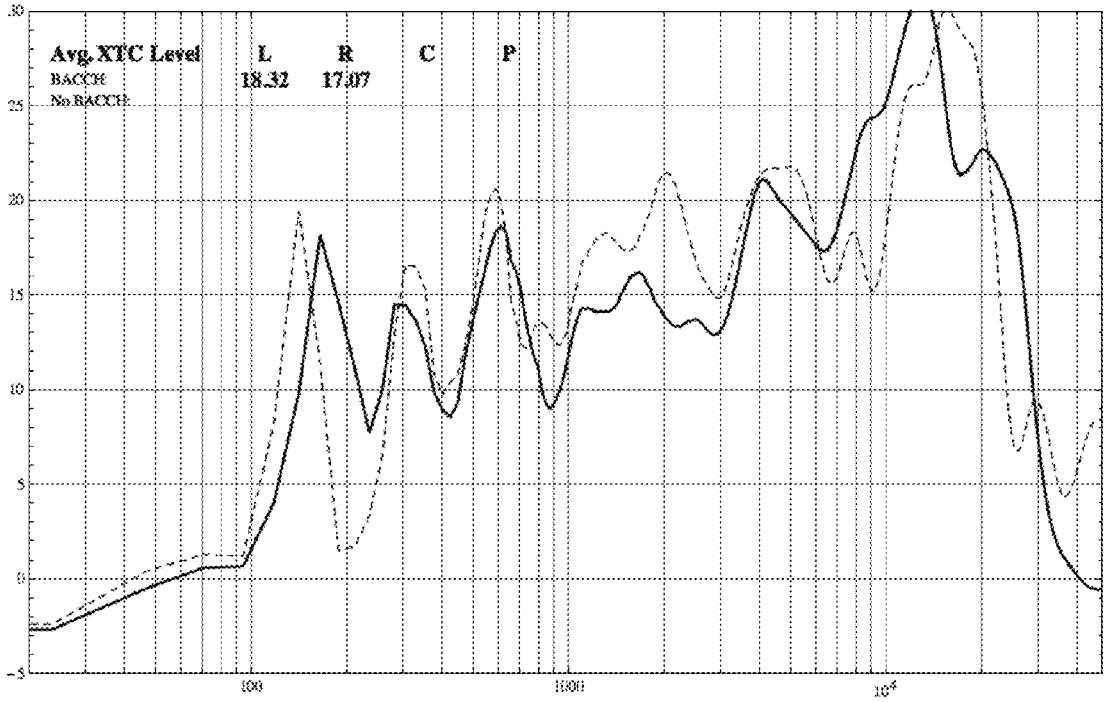
FIG. 7 is a plot of the measured crosstalk cancellation performance of the SU-XTC filter shown in FIG. 6.

An example of such a SU-XTC filter resulting from Step 4 is shown in FIG. 6 as a set of the 2×2 IRs corresponding to the SRbIR example shown in FIG. 4. The measured crosstalk cancellation performance of this filter is shown in FIG. 7 (solid curve: signal input in left channel only with sound level measured at the left ear; dashed curve: signal input in right channel only with sound level measured at right ear). (The average XTC level in this example is above 17 dB.).

Figure 9:
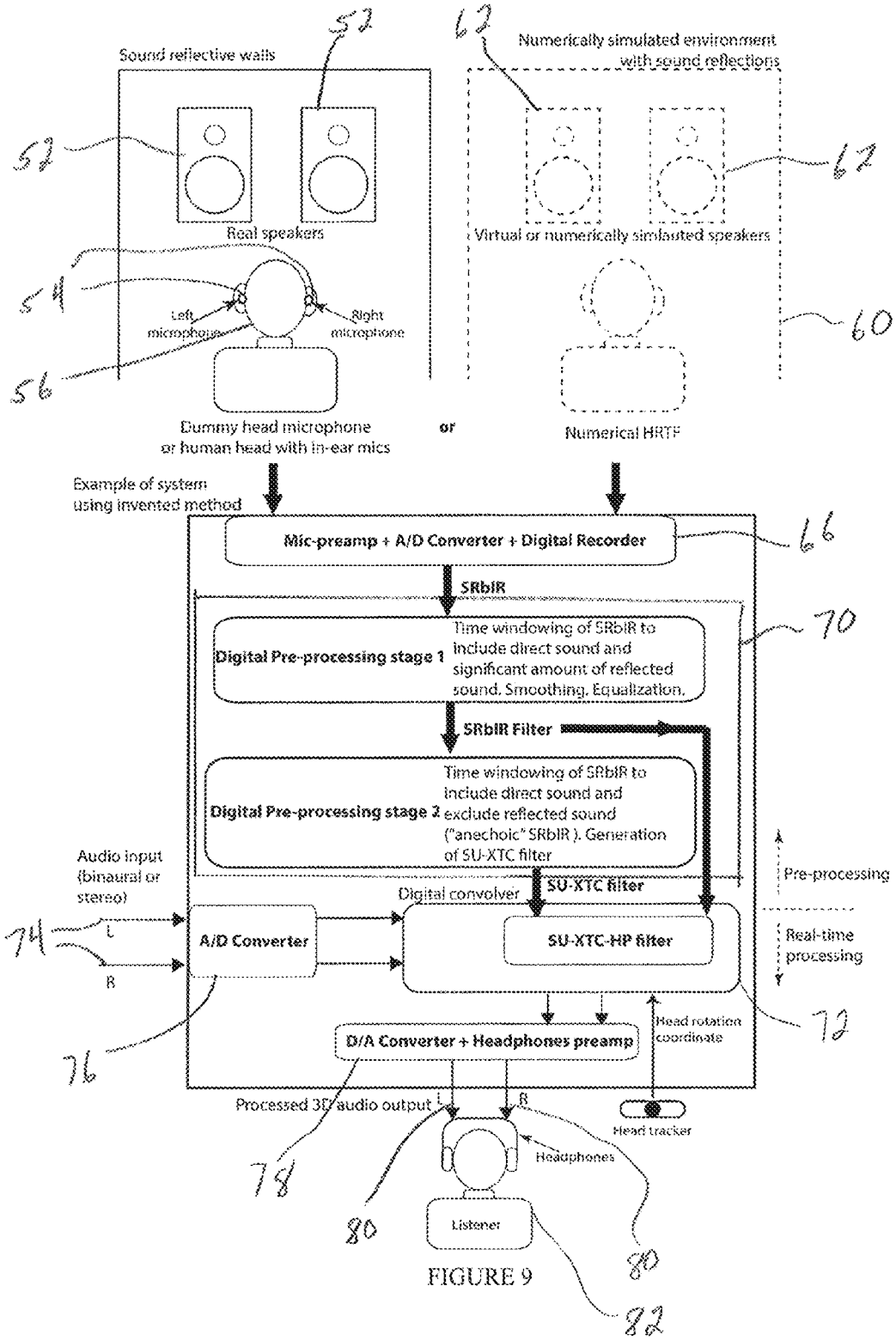
FIG. 9 is a diagram for an example of a system (a 3D-Audio headphones processor) of the present invention for producing audio filters for processing audio signals to produce a head-externalized 3D audio image.

The frequency response of the SU-XTC for a signal input only in the left channel or a signal input only in the right channel is shown as an essentially flat line in the lower part of the plot in FIG. 9, as expected from an SU-XTC filter.

Step 5: The final SU-XTC-HP filter is the combination of the SRbIR obtained in Step 2 and the SU-XTC filter obtained in Step 4. This combination can be made by either convolving the two filters together then using the resulting single SU-XTC-HP to filter the raw audio for the headphones, or alternatively by convolving the raw audio with the SU-XTC filter (e.g. that shown in FIG. 6) and the SRbIR (e.g. that shown in FIG. 4) separately in series (each of this convolution is a "true stereo" or 2×2 convolution). The two methods are equivalent, but the second one has the advantage of allowing the SU-XTC convolution to be bypassed so that an A/B comparison of the head externalized but not 3D sound (as would be produced by PA Method 2) can be made with the full 3D and head-externalized sound of the SU-XTC-HP filter (with the SU-XTC-HP filter not bypassed).

Figure 8:
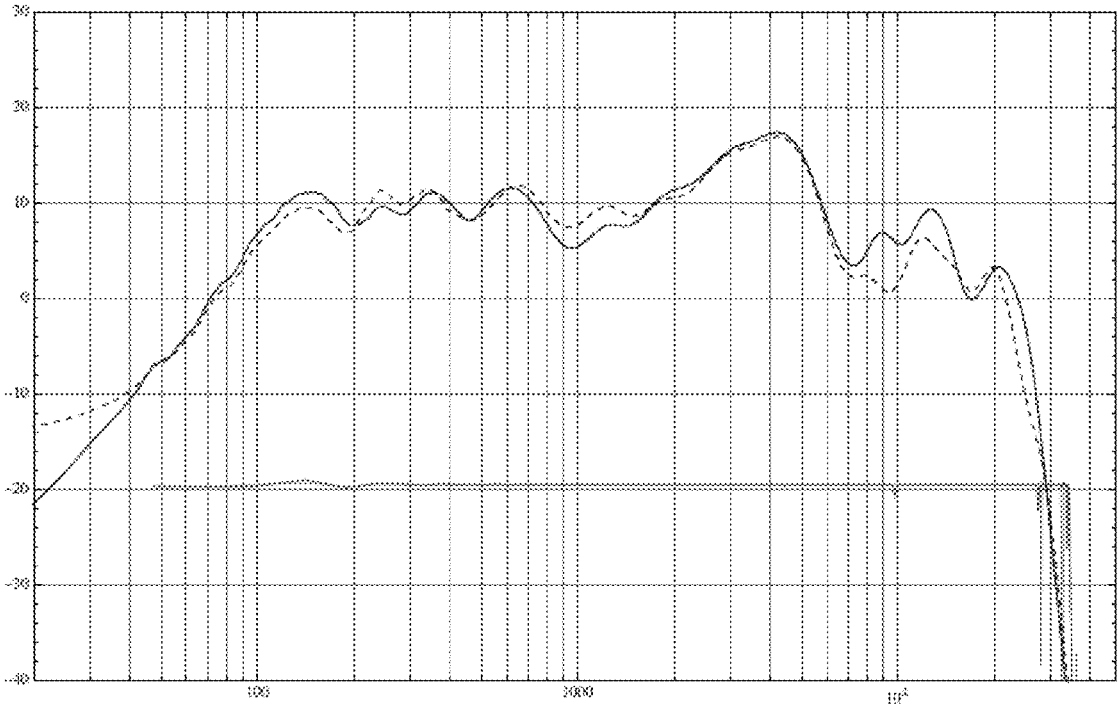
FIG. 8 is a plot of the frequency response (bottom flat curve) of the SU-XTC filter shown in FIG. 6 and the frequency response (top two curves) of the spectrally uncolored crosstalk cancellation HP filter generated in the process shown in FIG. 4

Since the frequency response of the SU-XTC filter is flat, that of the SU-XTC-HP filter (shown in the upper two curves of FIG. 8) is essentially the same as that of the SRbIR (shown in FIG. 5), as can be verified by comparing the two figures. This ensures that the listener perceives the same sound through the headphones had the listener been actually listening to the crosstalk-cancelled (virtual or real) loudspeakers used to obtain the SRbIR.

A corollary of the method described above is its allowance (unlike PA Method 1) of the use of existing head tracking techniques to fix the perceived 3D image in space by tracking of the listener's head rotation with a sensor and using the instantaneously measured head rotation coordinate (the yaw angle) in real time to adjust the image, which is achieved, as in prior art, by shifting to the appropriate (SU-XTC-HP) filter corresponding to that azimuthal angle derived from interpolation between two (SU-XTC-HP) filters corresponding to locations where measurements (or simulations) were made beforehand. Without such an adjustment, the head externalization of sound is known to suffer considerably when the head is rotated.

The requirement of head tracking hardware and software adds some additional cost and complexity compared to regular headphones, however, commercially existing and cost effective head tracking hardware and software, as is often used in the gaming industry (e.g. TrackIR, Kinect, Visage SDK), work very effectively for that purpose. These include optical sensors, e,g, cameras, infrared sensors or inertial measurement units (e.g. micro-gyroscopes, accelerometers, gyroscopes and magnetometers).

The head tracking solution also relies on previously existing IR interpolation and sliding convolution methods that require that three SU-XTC-HP filters be made through three SRbIR measurements (as part of Step 1 of the method described above), one corresponding to the head in the center listening position, one to the head rotated to the extreme left and the third to the head rotated to the extreme right. A bank of SU-XTC-HP filters (typically 40 filters have been found to be enough for most applications) is then built quickly through interpolation between these 3 anchor filters and the appropriate filter is selected on the fly according to the instantaneous value of the head rotation coordinate (yaw). These techniques are described in prior art literature, for instance P. V. H. Mannerheim "Visually Adaptive Virtual Sound Imaging using Loudspeakers", PhD Thesis, Univ. of South Hampton, February 2008, the teachings of which are incorporated herein by reference.

An example of a system utilizing the invented method is shown in FIG. 9. The system amounts to a 3D audio headphones processor based on the SU-XTC-HP filter. The system utilizes an IR measurement system 50 to measure the IR of a pair of loudspeakers in a (non-anechoic) room or a simulation system 60 to simulate the binaural response of a pair of loudspeakers with sound reflections 62. In the IR measurement system, a pair of in-ear microphones 54 are worn a human or dummy head 56. The measured or simulated IR is then processed by a mic-preamp and A/D converter 66 to produce the SRbIR.

A processor 70 windows the SRbIR to include sound and reflected sound. The processor 70 will also smooth and equalize the binaural IR in some embodiments as described in connection with Step 2 above. The processor 70 will also window the 4 IRs in the SRbIR to include direct sound and exclude reflected sound before generating the SU-XTC filter, which is combined with the SRbIR filter to produce the SU-XTC-HP filter by combining the SRbIR filter with the SU-XTC filter. Raw audio 74 processed through A/D converter 76 is fed through the convolver 72 which filters the audio using the SU-XTC-HP filter. The filtered audio is fed to a D/A converter and headphones preamp 78 to produce a processed 3D audio output 80. The processed output 80 is then fed to a headphones set worn by the listener 82. The digital pre-processing correspond to the steps of the invented method described above. A head tracker 83 can be used to track the listener's head rotation and generate the instantaneous head yaw coordinate that is fed to the convolver 72 to adjust the convolution as a function of the instantaneous head yaw angle.

While the foregoing invention has been described with reference to its preferred embodiments, various alterations and modifications are likely to occur to those skilled in the art. All such alterations and modifications are intended to fall within the scope of the appended claims.

What is claimed is:

1. A method of producing audio filters for processing audio signals to generate a head-externalized 3D audio image through headphones comprising the steps of:

measuring an impulse response of a pair of speakers in a room with an impulse response measurement system using binaural microphones inserted in ears of a head, generating a Speaker+Room Binaural Impulse Response (SRbIR) filter from said impulse response having the specific property of including direct sound and reflected sound, said SRbiR filter being made up of four actual impulse responses;

generating a spectrally uncolored crosstalk cancellation filter from a time-windowed version of said SRbIR filter that includes direct sound but excludes reflected sound;

utilizing a processor to filter the audio signals through a combination of said SRbIR filter and said crosstalk cancellation filter to generate a stereo audio signal; and feeding the resulting stereo audio signal to headphones to provide the listener with an emulation of audio playback through crosstalk-cancelled speakers that gives the perception of a head-externalized 3D audio image.

2. The method of producing audio filters of claim 1 wherein said headphones are earphones.

3. The method of producing audio filters of claim 1 wherein said headphones are ear speakers.

4. The method of producing audio filters of claim 1 wherein said headphones are transducers designed to be placed in close proximity to listener's ear.

5. The method of producing audio filters of claim 1 wherein said SRbIR is obtained by measuring said impulse response.

6. The method of producing audio filters of claim 1 wherein said SRbIR is obtained by analytical or numerical modeling of said impulse response.

7. The method of producing audio filters of claim 1 wherein said SRbIR is obtained by calculating said impulse response.

8. The method of producing audio filters of claim 1 wherein the step of providing the SRbIR filter comprises the step of constructing the SRbIR using a generic head related transfer function (HRTF) of a dummy.

9. The method of producing audio filters of claim 1 wherein said crosstalk cancellation filter is based on the anechoic impulse response of the speakers.

10. The method of producing audio filters of claim 1 wherein the azimuthal span, as measured from the listener's position, between two loudspeakers represented by the SRbIR is of a span angle of +/−45 degrees or less.

11. The method of producing audio filters of claim 1 wherein said step of combining said SRbIR and crosstalk cancellation filters comprises convolving said SRbIR and crosstalk cancellation filters together and using a resulting filter to process the audio signal.

12. The method of producing audio filters of claim 1 wherein said step of combining the SRbIR and crosstalk cancellation filters comprises convolving the audio signal with two filters in series.

13. The method of producing audio filters of claim 1 further comprising the step of using head tracking techniques to adjust head-externalized 3D audio image.

14. The method of producing audio filters of claim 1 wherein non-individualized HRTFs are used to construct said SRbIR.

15. The method of producing audio filters of claim 1 wherein individualized HRTF are used to construct said SRbIR.

16. The method of producing audio filters of claim 1 wherein said processor filters any audio signal through both the SRbIR filter and crosstalk cancellation filter in series.

17. The method of producing audio filters of claim 1 wherein said processor filters any audio signal through both the SRbIR filter and crosstalk cancellation filter through a filter made from a numerical combination of said SRbIR filter and said crosstalk cancellation filter.

18. The method of producing audio filters of claim 1 wherein said step of combining said SRbIR filter and said crosstalk cancellation filter is made by measuring the impulse response of the speakers through said crosstalk cancellation filter, which is a measurement of impulse response of said crosstalk-cancelled speakers.

19. A system for producing audio filters for processing audio signals to generate a head-externalized 3D audio image through headphones comprising:

an impulse response measurement system including binaural microphones insertable in ears of said head;

at least one processor for measuring a windowed binaural response of a pair of speakers from one or more impulse responses received from said impulse response measurement system, said at least one processor also generating a Speaker+Room Binaural Impulse Response (SRbIR) filter from said windowed binaural response, said SRbIR filter having a specific property of including direct sound and reflected sound;

said at least one processor for generating a crosstalk cancellation filter from a time-windowed version of said SRbIR filter that includes direct sound but excludes reflected sound, said at least one processor filtering the audio signals through a combination of said SRbIR filter and said crosstalk cancellation filter to generate a stereo sound; and headphones for receiving the resulting stereo audio signal to provide a listener with an emulation of audio playback through crosstalk-cancelled speakers that gives the perception of a head-externalized 3D audio image.

20. A system for producing audio filters of claim 19 wherein said binaural response generator comprises a pair of in-ear binaural microphones.

* * * * *